US009992596B2

(12) United States Patent
Russell et al.

(10) Patent No.: US 9,992,596 B2
(45) Date of Patent: Jun. 5, 2018

(54) HIGH DISPLACEMENT ACOUSTIC TRANSDUCER SYSTEMS

(71) Applicant: AUDERA ACOUSTICS INC., Schomberg (CA)

(72) Inventors: David Russell, Toronto (CA); John French, Caledon East (CA)

(73) Assignee: AUDERA ACOUSTICS INC., Schomberg (CA)

( * ) Notice: Subject to any disclaimer, the term of this patent is extended or adjusted under 35 U.S.C. 154(b) by 125 days.

(21) Appl. No.: 14/953,100

(22) Filed: Nov. 27, 2015

(65) Prior Publication Data

US 2016/0157035 A1 Jun. 2, 2016

Related U.S. Application Data

(60) Provisional application No. 62/085,436, filed on Nov. 28, 2014, provisional application No. 62/197,345, filed on Jul. 27, 2015.

(51) Int. Cl.
*H04R 9/02* (2006.01)
*H04R 29/00* (2006.01)
(Continued)

(52) U.S. Cl.
CPC ..... *H04R 29/003* (2013.01); *H04R 7/16* (2013.01); *H04R 9/022* (2013.01); *H04R 9/025* (2013.01); *H04R 3/007* (2013.01)

(58) Field of Classification Search
CPC ..... H04R 29/003; H04R 7/16; H04R 9/022; H04R 9/025; H04R 3/007
See application file for complete search history.

(56) References Cited

U.S. PATENT DOCUMENTS 4,295,011 A * 10/1981 Hathaway ..... H04R 9/025 181/167
4,661,973 A * 4/1987 Takahashi ..... H04R 9/025 379/194

(Continued)

FOREIGN PATENT DOCUMENTS

WO 94/16536 A1 7/1994

OTHER PUBLICATIONS

Documents relating to corresponding International Patent Application No. PCT/CA2015/051241, dated Feb. 9, 2016 (Written Opinion and International Search Report).

*Primary Examiner* — Duc Nguyen
*Assistant Examiner* — Taunya McCarty
(74) *Attorney, Agent, or Firm* — Bereskin & Parr LLP/S.E.N.C.R.L., s.r.l.

(57) ABSTRACT

Acoustic transducer systems are described herein and in particular, acoustic transducer systems involving high displacement are described. An example acoustic transducer system includes an acoustic driver, a diaphragm position sensing module for generating a position signal corresponding to a displacement of a diaphragm of the acoustic driver, and a controller operable to: receive an input audio signal; generate a control signal based at least on the input audio signal and the position signal; and transmit the control signal to a voice coil operably coupled to the diaphragm so that the voice coil moves within an air gap within the acoustic driver at least partially in response to the control signal. A height of the voice coil can correspond substantially to a gap height in some embodiments.

25 Claims, 9 Drawing Sheets

(51) Int. Cl.
*H04R 7/16* (2006.01)
*H04R 3/00* (2006.01)

(56) References Cited

U.S. PATENT DOCUMENTS

| | | | | | |
|---|---|---|---|---|---|
| 4,980,920 | A * | 12/1990 | Noro | H03F 1/56 | 381/59 |
| 7,065,225 | B2 * | 6/2006 | Stiles | H04R 9/025 | 381/412 |
| 7,961,892 | B2 * | 6/2011 | Fedigan | H04R 9/063 | 381/117 |
| 8,284,982 | B2 | 10/2012 | Bailey | | |
| 2006/0269095 | A1 * | 11/2006 | Matsumura | H04R 1/2803 | 381/421 |
| 2007/0140058 | A1 | 6/2007 | McIntosh et al. | | |
| 2012/0257782 | A1 | 10/2012 | French et al. | | |
| 2014/0241536 | A1 | 8/2014 | Adams et al. | | |
| 2015/0124982 | A1 | 5/2015 | Berthelsen et al. | | |

* cited by examiner

HIGH DISPLACEMENT ACOUSTIC TRANSDUCER SYSTEMS

CROSS-REFERENCE TO RELATED PATENT APPLICATIONS

The application claims the benefit of U.S. Provisional Application No. 62/085,436, filed on Nov. 28, 2014 and U.S. Provisional Application No. 62/197,345, filed on Jul. 27, 2015. The complete disclosure of each of U.S. Provisional Application No. 62/085,436 and U.S. Provisional Application No. 62/197,345 is incorporated herein by reference.

FIELD

The described embodiments relate to acoustic transducer systems and in particular, some embodiments relate to acoustic transducer systems involving high displacement.

BACKGROUND

Acoustic transducer systems can operate to convert electrical signals into output audio signals. The design topology of the acoustic transducer systems can affect its performance.

Common acoustic transducer systems involve a voice coil that receives the electrical signals from an audio source. The signal at the voice coil can then cause a magnetic flux to be generated by the voice coil in the driver motor of the acoustic transducer system. The diaphragm can then move in response to the magnetic flux to generate the output audio signal.

The voice coil in the acoustic transducer systems can be provided using different topologies. The voice coil can be coupled with the diaphragm and can be configured to move at least partially within an air gap of the acoustic transducer motor. In an example topology, the voice coil can be underhung, which can increase the efficiency of the acoustic transducer system due to the lighter voice coil and lower resistance associated with a shorter voice coil. Another topology can involve an overhung voice coil, which can be characterized by decreased efficiency as compared to the underhung design, but can generate a more linear output audio signal at higher displacement.

The voice coil can also be provided in an evenly hung topology. In comparison with the overhung and underhung topologies, the evenly hung voice coil can offer a more efficient performance but the performance can be limited by distortions caused by the displacement of the voice coil.

SUMMARY

The various embodiments described herein generally relate to acoustic transducer systems and in particular, to acoustic transducer systems involving high displacement.

An example acoustic transducer system described herein can include: a driver motor operable to generate a magnetic flux; a diaphragm operably coupled to the driver motor; a voice coil coupled to the diaphragm, the voice coil may be movable at least in response to the magnetic flux; a diaphragm position sensing module generating a position signal corresponding to a displacement of the diaphragm, the displacement being a position of the diaphragm relative to an initial position of the diaphragm; and a controller in electronic communication with the driver motor and the diaphragm position sensing module, the controller being operable to: receive an input audio signal; generate a control signal based at least on a version of the input audio signal and the position signal; and transmit the control signal to the voice coil, the voice coil moving at least in response to the control signal.

In some embodiments, the driver motor may include an axial post; a bottom plate extending away from the axial post; a top plate having an interior surface facing the axial post, the top plate and the axial post defining an air gap therebetween; and a magnetic element positioned between the bottom plate and the top plate, the magnetic element may be spaced away from the axial post and the magnetic element may be operable to generate a magnetic flux; and the voice coil may be movable at least partially within the air gap.

In some embodiments, the voice coil may have a coil height corresponding substantially to a gap height of the air gap.

In some embodiments, the axial post may include a center post located at a substantially central region of the driver motor.

In some embodiments, the axial post may include an outer wall of the driver motor.

In some embodiments, the magnetic element may be coupled between the bottom portion and a bottom surface of the top plate; and the driver motor may include a second magnetic element coupled to a top surface of the top plate, the top surface of the top plate may be opposite from the bottom surface of the top plate.

In some embodiments, the top plate may include an interior portion and an exterior portion coupled to the interior portion, a surface of the interior portion may be the interior surface and the magnetic element may be coupled to the top plate via the exterior portion, a height of the exterior portion may be less than a height of the interior surface.

In some embodiments, at least one of a top surface and a bottom surface of the interior portion of the top plate may be tapered towards the exterior portion.

In some embodiments, the magnetic element may extend further away from the axial post than at least one of the bottom plate and the top plate.

In some embodiments, the axial post and the bottom plate may define a driver cavity within the driver motor for at least partially receiving the voice coil.

In some embodiments, the driver motor may be configured to accommodate a movement of the voice coil, the voice coil may be movable towards and away from the bottom plate within a displacement range, the displacement range may extend from each end of the air gap and the displacement range may correspond to at least a coil height of the voice coil.

In some embodiments, a cross-sectional area of the axial post may be at most equal to an area of the interior surface.

In some embodiments, the axial post may include a top portion and a bottom portion coupled to the top portion, a surface of the top portion partially facing the interior surface of the top plate and the bottom portion may be coupled to the bottom plate.

In some embodiments, the bottom portion of the axial post may be tapered away from the bottom plate.

In some embodiments, the top portion of the axial post may be tapered away from the air gap.

In some embodiments, the top portion may partially extend away from the bottom plate for extending the gap height.

In some embodiments, the diaphragm position sensing module may include a position sensor for detecting the displacement of the diaphragm.

In some embodiments, the diaphragm position sensing module may include one of an ultrasonic sensor, an optical sensor, magnetic sensor, and a pressure sensor.

In some embodiments, the controller may include: a correction module configured to generate a correction signal based on the position signal received from the diaphragm position sensing module, the correction signal compensating, at least, distortions associated with the detected displacement; and a combiner module configured to receive the correction signal from the correction module and to generate the control signal based on, at least, the correction signal and the version of the input audio signal.

In some embodiments, the combiner module may include a divider, the control signal corresponding to a ratio of the version of the input audio signal and the correction signal.

In some embodiments, the controller may be operable to receive the input audio signal from a current source, and the controller may include a preprocessing filter for: receiving the input audio signal from the current source; determining a target response defined for the acoustic transducer system, the target response may be a desired type of output signal for the acoustic transducer system; generating a preprocessed input audio signal from the input audio signal with reference to the target response, the input audio signal may be adjusted to accommodate generation of the desired type of output signal; and transmitting the preprocessed input audio signal to the combiner module.

In some embodiments, the preprocessing filter may include an equalization filter.

In some embodiments, the controller may include a negative feedback module for receiving the position signal and generating a motional feedback signal based on, at least, the position signal, the motional feedback signal operating to accommodate generation of a target response by the acoustic transducer system, the target response may be a desired type of output signal for the acoustic transducer system; and the combiner module generating the control signal based, at least, on the correction signal, the version of the input audio signal and the motional feedback signal.

In some embodiments, the negative feedback module may include: a velocity feedback module configured to generate a velocity correction signal based, at least, on the position signal; and a low pass filter configured to generate a version of the position signal; and the motional feedback signal may include the velocity correction signal and the version of the position signal.

In some embodiments, at least one temperature sensor may be coupled to the driver motor; and the correction module may be further configured to estimate a temperature of the voice coil based on a temperature of the driver motor detected by at least one temperature sensor; and generate the correction signal to minimize changes in performance of the acoustic transducer system due to the estimated temperature.

In some embodiments, the at least one temperature sensor may be coupled to the magnetic element.

In some embodiments, the acoustic transducer system may include a suspension structure operably coupled to the voice coil; and at least one temperature sensor may be coupled to the suspension structure.

In some embodiments, the controller may operate to: determine, from the position signal, whether the displacement of the diaphragm satisfies a displacement limit defined for the acoustic transducer system, the displacement limit representing a maximum displacement range for the acoustic transducer system; and in response to determining the displacement of the diaphragm satisfies the displacement limit, define the control signal to cause no movement at the voice coil, otherwise, generate the control signal based at least on the version of the input audio signal and the position signal.

An example method of operating an acoustic transducer system described herein can include: generating, by a diaphragm position sensing module, a position signal corresponding to a displacement of a diaphragm operably coupled to a driver motor of the acoustic transducer system, the driver motor being operable to generate a magnetic flux and a voice coil coupled to the diaphragm is movable at least in response to the magnetic flux, the displacement of the diaphragm may be detected relative to an initial position of the diaphragm; and operating a controller in electronic communication with the driver motor and the diaphragm position sensing module to: receive an input audio signal; generate a control signal based at least on a version of the input audio signal and the position signal; and transmit the control signal to the voice coil, the voice coil moving at least in response to the control signal.

In some embodiments, the diaphragm position sensing module may include a position sensor for detecting the displacement of the diaphragm.

In some embodiments, the diaphragm position sensing module may include one of an ultrasonic sensor, an optical sensor, magnetic sensor, and a pressure sensor.

In some embodiments, generating a correction signal based on the position signal received from the diaphragm position sensing module, the correction signal compensating, at least, distortions associated with the detected displacement of the diaphragm; and generating the control signal based on, at least, the correction signal and a version of the input audio signal.

In some embodiments, generating the control signal may include determining a ratio of the version of the input audio signal to the correction signal.

In some embodiments, generating the control signal may include: receiving the input audio signal from a current source; determining a target response defined for the acoustic transducer system, the target response may be a desired type of output signal for the acoustic transducer system; generating a preprocessed input audio signal from the input audio signal with reference to the target response, the input audio signal may be adjusted to accommodate generation of the desired type of output signal; and generating the control signal based on, at least, the correction signal and the preprocessed input audio signal.

In some embodiments, generating a motional feedback signal based on, at least, the position signal, the motional feedback signal operating to accommodate generation of a target response by the acoustic transducer system, the target response may be a desired type of output signal for the acoustic transducer system; and generating the control signal based, at least, on the correction signal, the version of the input audio signal and the motional feedback signal.

In some embodiments, generating a velocity correction signal based, at least, on the position signal; and generating the motional feedback signal based on the velocity correction signal and a version of the position signal.

In some embodiments, generating the correction signal based on the position signal may include: detecting a temperature at the driver motor; estimating a temperature of the voice coil based on the detected temperature; and generating the correction signal to minimize changes to a performance of the acoustic transducer system due to the estimated temperature.

In some embodiments, the driver motor may include a magnetic element operable to generate the magnetic flux; and detecting the temperature at the driver motor may include at least one of detecting the temperature at the magnetic element and detecting the temperature in the surrounding of the magnetic element.

In some embodiments, the driver motor may include a suspension structure operably coupled to the voice coil; and detecting the temperature at the driver motor may include at least one of detecting the temperature at the suspension structure and detecting the temperature in the surrounding of the suspension structure.

In some embodiments, generating the control signal based at least on the version of the input audio signal and the position signal may include: determining, from the position signal, whether the displacement of the diaphragm satisfies a displacement limit defined for the acoustic transducer system, the displacement limit representing a maximum displacement range for the acoustic transducer system; and in response to determining the displacement of the diaphragm satisfies the displacement limit, defining the control signal to cause no movement at the voice coil, otherwise, generating the control signal based at least on the version of the input audio signal and the position signal.

BRIEF DESCRIPTION OF THE DRAWINGS

Several embodiments will now be described in detail with reference to the drawings, in which.

Figure 1:
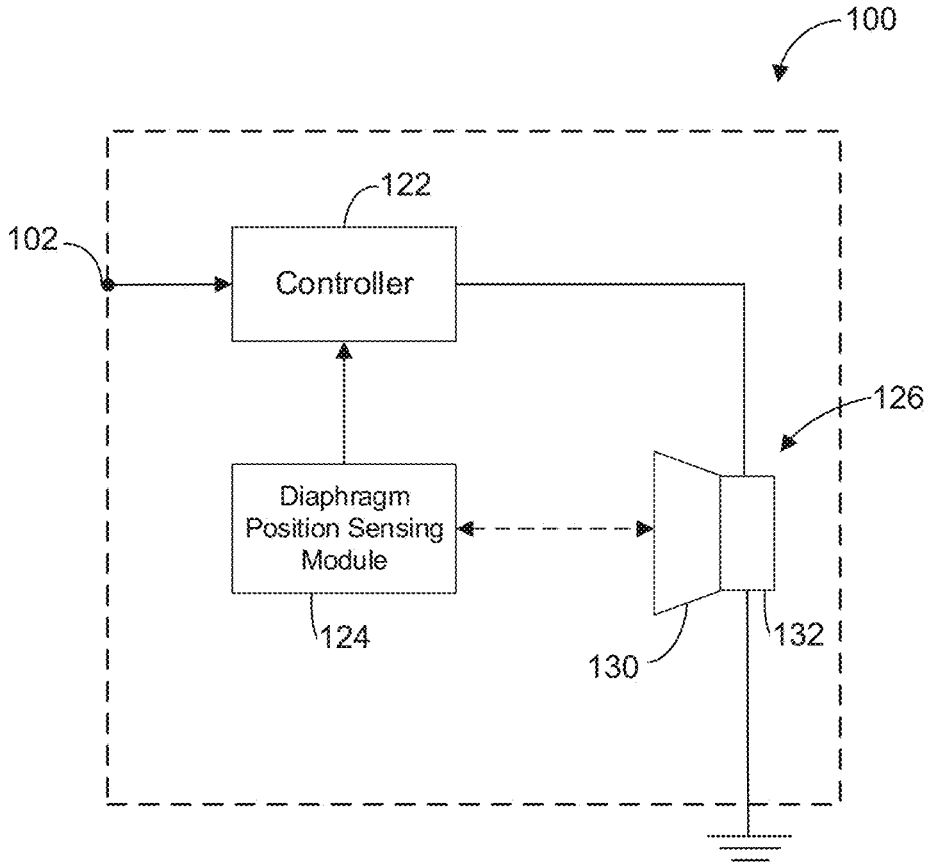
FIG. 1 is a block diagram of an acoustic transducer system in accordance with an example embodiment.

The drawings, described below, are provided for purposes of illustration, and not of limitation, of the aspects and features of various examples of embodiments described herein. For simplicity and clarity of illustration, elements shown in the drawings have not necessarily been drawn to scale. The dimensions of some of the elements may be exaggerated relative to other elements for clarity. It will be appreciated that for simplicity and clarity of illustration, where considered appropriate, reference numerals may be repeated among the drawings to indicate corresponding or analogous elements or steps.

DESCRIPTION OF EXAMPLE EMBODIMENTS

It will be appreciated that numerous specific details are set forth in order to provide a thorough understanding of the example embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description and the drawings are not to be considered as limiting the scope of the embodiments described herein in any way, but rather as merely describing the implementation of the various embodiments described herein.

It should be noted that terms of degree such as "substantially", "about" and "approximately" when used herein mean a reasonable amount of deviation of the modified term such that the end result is not significantly changed. These terms of degree should be construed as including a deviation of the modified term if this deviation would not negate the meaning of the term it modifies.

In addition, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that the term "coupled" used herein indicates that two elements can be directly coupled to one another or coupled to one another through one or more intermediate elements. The term "coupled" can, in some embodiments, also indicate that the two elements are integrally formed.

Reference is first made to FIG. 1, which illustrates an example acoustic transducer system 100. The acoustic transducer system 100 includes a controller 122, a diaphragm position sensing module 124 and a driver 126. The driver 126, as shown, includes a diaphragm 130 operably coupled to a driver motor 132.

Some embodiments of the drivers 126 can be configured in substantially evenly hung topologies. In comparison with driver motors 132 with underhung or overhung voice coils, a driver motor 132 with evenly hung voice coils can, in some embodiments, offer a more efficient overall acoustic transducer system when distortions caused by displacements of the substantially evenly hung voice coils can be minimized. The acoustic transducer systems 100 described herein can be configured, at least, to compensate for distortions that may arise from displacements of the evenly hung voice coils.

As shown in FIG. 1, the controller 122 can be in electronic communication with the driver 126 and the diaphragm position sensing module 124. The controller 122 may be implemented in software or hardware, or a combination thereof. The hardware may be digital, analog, or a combination thereof.

The controller 122 can receive an input audio signal from an input terminal 102. The input terminal 102 can be coupled to an audio source (not shown) for providing the input audio signal. The input audio signal may be a one volt peak-to-peak signal with a time varying magnitude and a time-varying frequency. In other embodiments, the input audio signal may be any other type of analog or digital audio signal.

The controller 122 can receive a position signal generated by the diaphragm position sensing module 124. The diaphragm position sensing module 124 can operate to generate the position signal based on a displacement of the diaphragm 130 during operation of the acoustic transducer system 100. The diaphragm position sensing module 124 can, in some embodiments, include a position sensor for detecting the displacement of the diaphragm 130.

Various implementations of the position sensor may be used. For example, the position sensor can be implemented using optical methods (e.g., an optical sensor, such as a laser displacement sensor), or methods involving measurement of electrical capacitance, inductance or mutual coupling that varies with the displacement of the diaphragm 130. The position sensor may also be implemented as an ultrasonic sensor, a magnetic sensor or an acoustic pressure sensor. Another example implementation of the position sensor can include a strain gauge.

Depending on the intended application of the acoustic transducer system 100, optical methods may be impractical since the fabrication processes involved may be too expensive and/or may not be scalable to smaller-scale devices. Strain gauges can operate based on a bulk or piezoelectric property of a component of the driver 126, such as a suspension component or a component at a mechanical interface between components of the driver 126.

Other implementations of the position sensor may be used. For example, the position sensor can include a low performance zero-cross sensor and an accelerometer or a velocity sensor. The zero-cross sensor can operate to maintain an average DC position, while a double integral of the accelerometer or single integral of the velocity sensor can indicate a movement of the diaphragm 130. The signal from the zero-cross sensor and one of the accelerometer or velocity sensor can be combined. For example, the signals from the zero-cross sensor and one of the accelerometer or velocity sensor can be summed with appropriate filtering and/or scaling.

Another example position sensor implementation can involve a position sensing module that operates to estimate the displacement of the diaphragm 130 using mathematical models generated for the driver 126 based on the current and/or voltage of the voice coil.

When the diaphragm 130 is stationary, that is, when no current is flowing through the voice coil, the diaphragm 130 is in an initial, or rest, position. The location of the diaphragm 130 at the initial position relative to the driver motor 132 can vary for different designs of the driver 126. When the diaphragm 130 is in motion, the diaphragm 130 can move relative to the driver motor 132 and the displacement of the diaphragm can correspond to a position of the diaphragm 130 relative to the initial position. As the diaphragm 130 moves, the voice coil operably coupled to the diaphragm 130 also moves with the diaphragm 130 so that the voice coil at least partially exits the air gap. When the voice coil exits the air gap, distortions in the resulting output audio signal produced by the driver 126 may result.

Based on the position signal and the input audio signal, the controller 122 can then generate a control signal to compensate for distortion associated with the displacement of the voice coil described herein. Various embodiments of the controller 122 will be described with reference to FIGS. 5 and 6.

Example embodiments of the driver motor 132 will now be described with reference to FIGS. 2 to 4.

Figure 2:
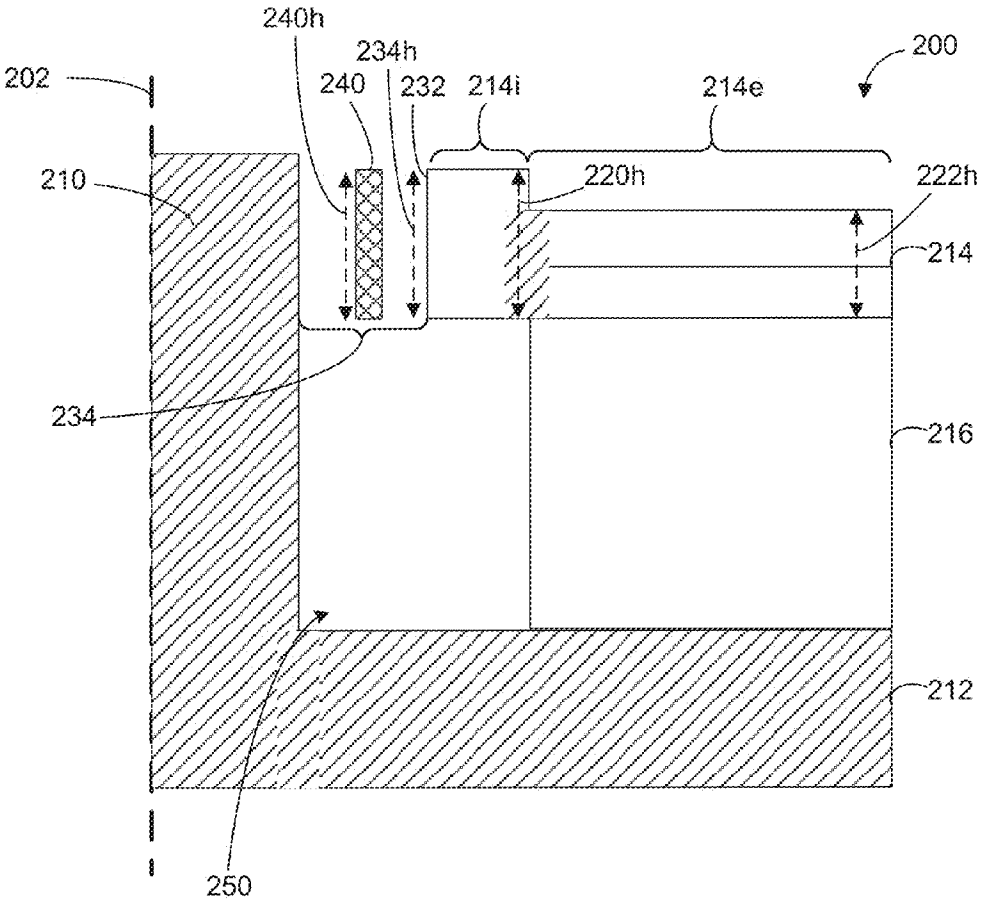
FIG. 2 is a partial cross-sectional drawing illustrating an example driver motor operable in the acoustic transducer systems described herein.

FIG. 2 is a partial cross-sectional drawing of an example driver motor 200. A center axis 202 is shown in FIG. 2 for illustrative purposes.

The driver motor 200 includes, at least, an axial post 210, a bottom plate 212 extending away from the axial post 210, and a top plate 214 with an interior surface 232 facing the axial post 210. In the embodiment shown in FIG. 2, the axial post 210 can be referred to as a center post since the axial post 210 is positioned at a substantially central region of the driver motor 200.

A magnetic element 216 can be positioned between the bottom plate 212 and the top plate 214 so that the magnetic element 216 is positioned within the path of the magnetic flux. The magnetic element 216 may be formed from one or more hard magnetic materials, such as, but not limited to, ferrite, neodymium-iron-boron, and Samarium-cobalt. Each of the center post 210, the bottom plate 212 and the top plate 214 may generally be manufactured from any suitably magnetically permeable materials, such as low carbon steel.

The top plate 214 and the center post 210 also define an air gap 234 therebetween. The air gap 234 can have a gap height 234*h*. A voice coil 240 operably coupled to the diaphragm 130 (not shown in FIG. 2) can move at least partially within the air gap 234 axially with respect to the driver motor 200. The voice coil 240 can generally move, at least, in response to the magnetic flux generated by the magnetic element 216 and the magnetic flux generated by the current in the voice coil 240. The movement of the voice coil 240 can be varied by the control signal received from the controller 122.

The voice coil 240 can have a coil height 240*h*. As shown in FIG. 2, the topology of the driver motor 200 is configured in a substantially evenly hung design and so, the coil height 240*h* can substantially correspond to the gap height 234*h*. In some embodiments, the coil height 240*h* may be equal to the gap height 234*h*.

As shown in FIG. 2, the magnetic element 216 can be spaced away from the center post 210 so that a driver cavity 250 can be provided. During movement of the diaphragm 130, the voice coil 240 can at least partially move into the driver cavity 250. The driver cavity 250 can be configured to accommodate the movement of the voice coil 240.

The driver 126 can be configured to accommodate the overall movement of the voice coil 240. In response to the magnetic flux generated by the magnetic element 216 and the current in the voice coil 240, the voice coil 240 will move axially towards and away from the bottom plate 212. The movement of the voice coil 240 can be limited to a displacement range that includes the voice coil 240 at least partially or, in some embodiments, completely above and below the air gap 234. The displacement range can, in some embodiments, correspond to substantially the coil height 240*h* from each end of the air gap 234.

The diaphragm 130 and the driver cavity 250, therefore, can be configured to accommodate the displacement range.

The drivers 126 described herein can involve a driver motor 200 characterized by a center post 210 with a cross-sectional area that is equal or less than an area of the interior surface 232. The top plate 214, therefore, may be formed with generally uniform geometry. However, the geometry of the top plate 214 may be modified to reduce unnecessary use of steel. As will be described with reference to FIGS. 3 and 4, other modifications of the top plate 214, the bottom plate 212 and/or the center post 210 may be applied to increase the linearity of the output audio signal without affecting the overall performance of the acoustic transducer systems 100 described herein.

As shown in FIG. 2, the top plate 214 may include an interior portion 214*i* and an exterior portion 214*e*. The interior portion 214*i* can be formed integrally with the exterior portion 214*e*, in some embodiments. The cross-sectional size of each of the interior portion 214*i* and the exterior portion 214*e* with respect to the overall top plate 214 is illustrated as being only an example and should not be construed as a limitation. The interior portion 214*i* and the exterior portion 214*e* can be sized according to the design requirements of the driver motor 200.

The interior portion 214*i* can include the interior surface 232, while the magnetic element 216 can be coupled to the top plate 214 at the exterior portion 214*e*. As seen in FIG. 2, the interior portion 214*i* and the exterior portion 214*e* can have different heights, 220*h* and 222*h*, respectively. To retain the gap height 234*h* while also reducing the amount of steel used, the interior height 220*h* of the interior portion 214*i* can be higher than the exterior height 222*h* of the exterior portion 214*e*.

Figure 3:
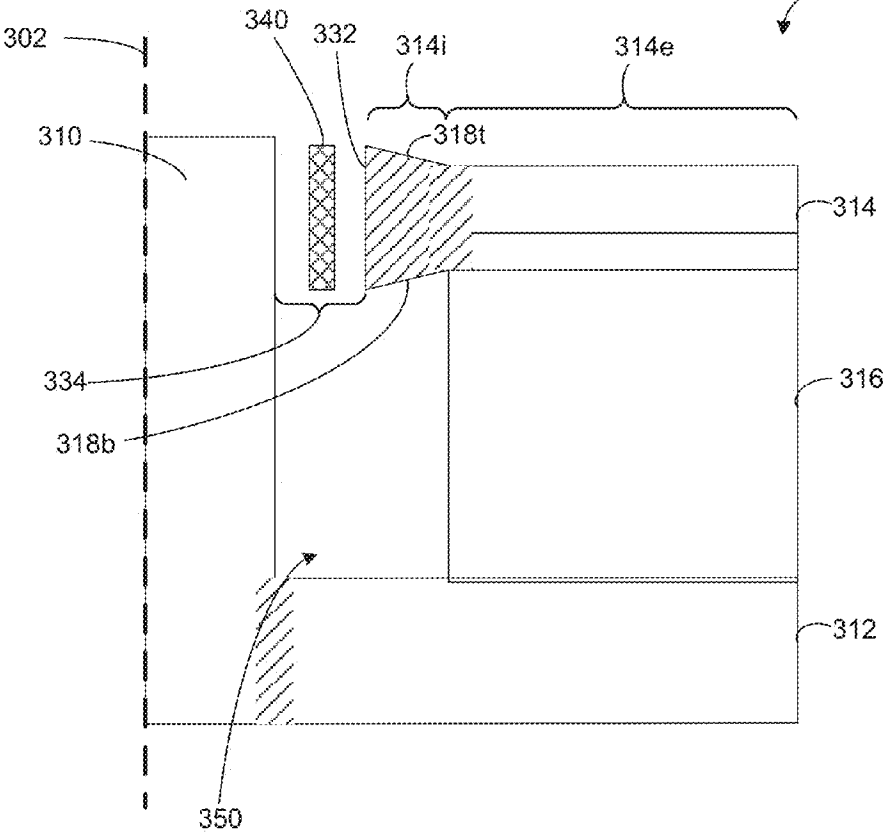
FIG. 3 is a partial cross-sectional drawing illustrating another example driver motor operable in the acoustic transducer systems described herein.

FIG. 3 is a partial cross-sectional drawing of another example driver motor 300. A center axis 302 is also shown in FIG. 3 for illustrative purposes.

The driver motor 300 shown in FIG. 3 is generally similar to the driver motor 200 of FIG. 2. The driver motor 300 includes a center post 310, a bottom plate 312 and a top plate 314. A magnetic element 316 is positioned between the top plate 314 and the bottom plate 312. The center post 310 and the top plate 314 also define an air gap 334. A driver cavity 350 can also be provided within the driver motor 300.

Similar to the top plate 214 of FIG. 2, the top plate 314 of FIG. 3 can include an interior portion 314*i* and an exterior portion 314*e*. As described, the interior portion 314*i* may be formed integrally with the exterior portion 314*e*, in some embodiments. The interior portion 314*i* can include the interior surface 332 facing the center post 310. However, unlike the top plate 214 of FIG. 2, a top surface 318*t* and a bottom surface 318*b* of the interior portion 314*i* can be tapered towards the exterior portion 314*e*. In some embodiments, only one of the top surface 318*t* and bottom surface 318*b* of the interior portion 314*i* is tapered. With the tapering of one or both of the top surface 318*t* and bottom surface 318*b*, the height of the driver motor 300 can be lower than the height of the driver motor 200 due to the reduced amount of steel used in the top plate 314. The driver motor 300 can then also have a lesser depth, allowing a greater displacement range for the voice coil 340 for the same driver height as a driver 126 involving the driver motor 200.

Figure 4:
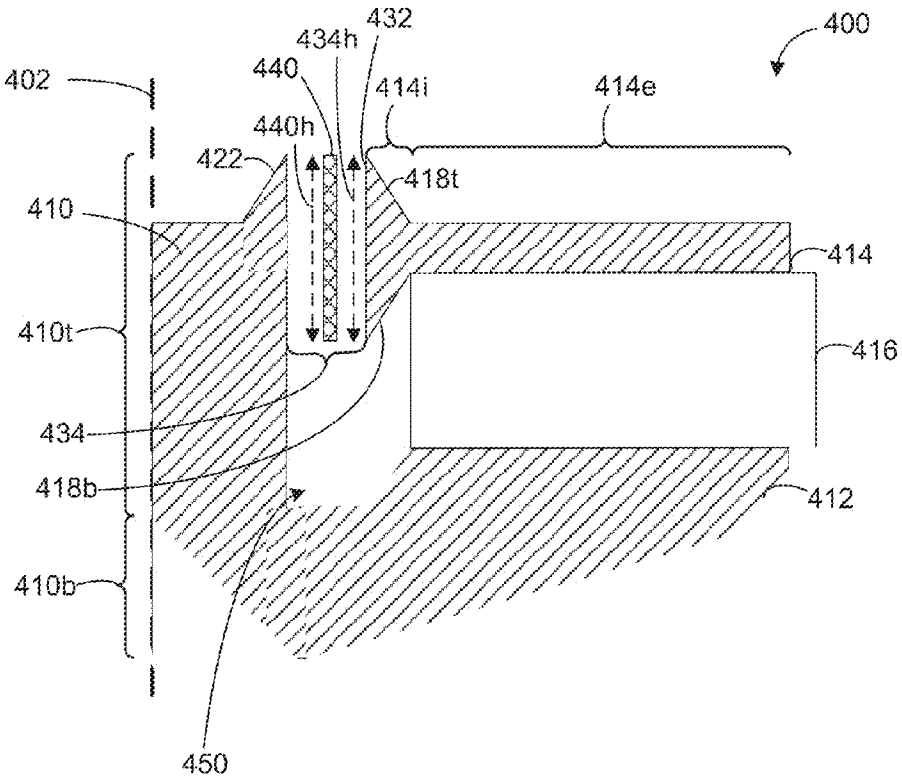
FIG. 4 is a partial cross-sectional drawing illustrating another example driver motor operable in the acoustic transducer systems described herein.

FIG. 4 is a partial cross-sectional drawing of yet another example driver motor 400. A center axis 402 is also shown in FIG. 4 for illustrative purposes.

Similar to the driver motors 200 and 300, the driver motor 400 shown in FIG. 4 also includes a center post 410, a bottom plate 412 and a top plate 414. A magnetic element 416 can also be positioned between the top plate 414 and the bottom plate 412. The center post 410 and the top plate 414 can define an air gap 434. A driver cavity 450 can also be provided within the driver motor 400.

As can be seen, the geometry of the driver motor 400 is different from the geometry of the driver motors 200 and 300. By modifying a geometry of one or more of the center post 410, the bottom plate 412 and the top plate 414, the weight of the driver motor 400 (along with the manufacturing cost) can be reduced.

For example, as illustrated, the magnetic element 416 can extend further away from the center post 410 than the bottom plate 412 and the top plate 414. The magnetic element 416 may, in some embodiments, extend further away from one of the bottom plate 412 and the top plate 414. The magnetic element 416 can be extended away from the driver cavity 450 to provide clearance for longer voice coils 440.

Also, as shown in FIG. 4, each of the magnetic element 416, the top plate 414 and the bottom plate 412 can be associated with different heights and/or different geometrical configurations. In some embodiments, the magnetic element 416 may be positioned substantially centrally between the top plate 414 and the bottom plate 412, or closer to one of the top plate 414 and the bottom plate 412.

Similar to the top plate 314 shown in FIG. 3, the top plate 414 of FIG. 4 can also include an interior portion 414*i* and an exterior portion 414*e*. In some embodiments, the interior portion 414*i* may be formed integrally with the exterior portion 414*e*. The interior portion 414*i* includes the interior surface 432. The top and bottom surfaces 418*t* and 418*b*, respectively, can be steeply tapered in comparison with a height of the exterior portion 414*e*.

The center post 410 can also be modified to reduce the amount of steel used. For example, the center post 410 can include a top portion 410*t* and a bottom portion 410*b* coupled to the top portion 410*t*. The top portion 410*t* can be formed integrally with the bottom portion 410*b*, in some embodiments. A surface of the top portion 410*t* can partially face the interior surface 432 of the top plate 414, while the bottom portion 410*b* can be coupled to the bottom plate 412.

In some embodiments, the top portion 410*t* of the center post 410 can be tapered away from the air gap 434. In the example shown in FIG. 4, the geometry of the top portion 410*t* can be modified, leaving a tapered surface 422 for retaining the gap height 434*h* with respect to the interior surface 432.

The geometry of the bottom portion 410*b* of the center post 410 can, in some embodiments, also be modified. For example, as shown in FIG. 4, the bottom portion 410*b* can be tapered away from the bottom plate 412.

Figure 5A:
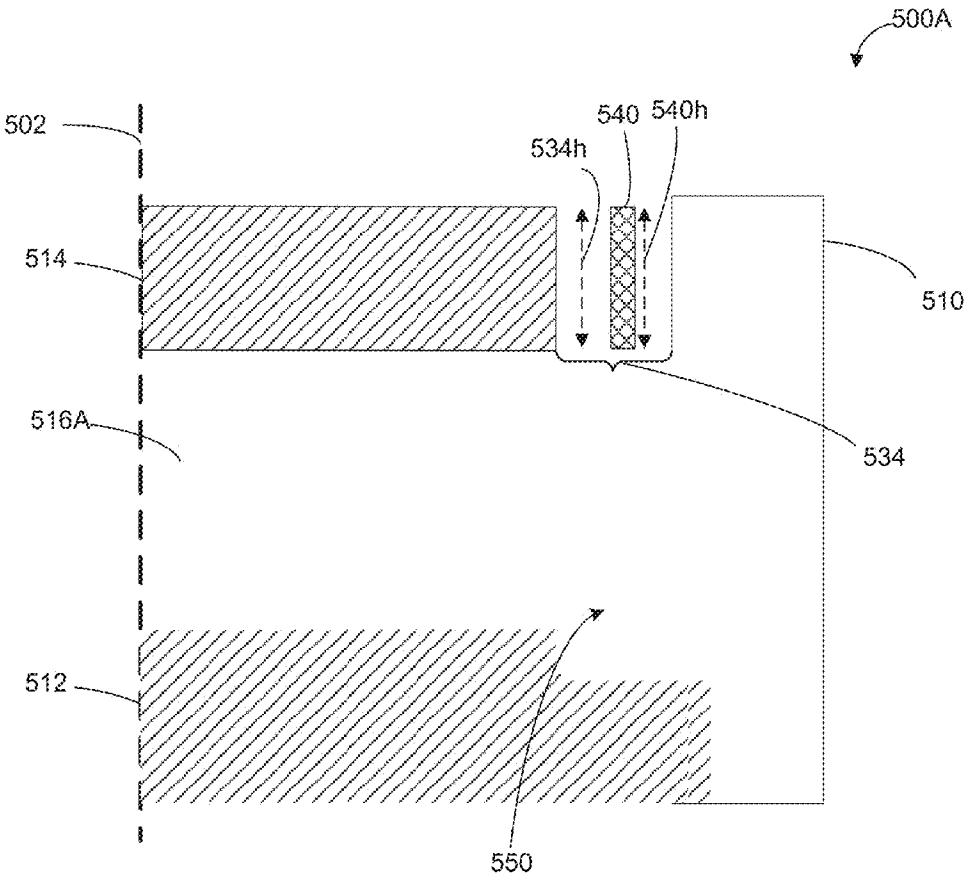
FIG. 5A is a partial cross-sectional drawing illustrating another example driver motor operable in the acoustic transducer systems described herein.

FIG. 5A is a partial cross-sectional drawing of yet another example driver motor 500A.

Unlike the driver motors 200 to 400 of FIGS. 2 to 4, respectively, the axial post 510 can form an outer wall for the driver motor 500A. For reference, the center axis 502 is shown in FIG. 5A and is located at a central region of the bottom plate 512, the top plate 514 and the magnetic element 516A. As shown in FIG. 5A, the magnetic element 516A can be positioned between the bottom plate 512 and the top plate 514. The outer wall 510 and the top plate 514 can define an air gap 534 with the gap height 534*h*. A driver cavity 550 can also be provided within the driver motor 500A.

As shown in FIG. 5A, the geometry of some of the components of the driver motor 500A defining the driver cavity 550 can be modified to reduce the use of steel, which can then also accommodate a larger displacement range for the voice coil 540.

Some embodiments of the driver motor 500A can include separate magnetic elements 516 that are generally positioned within the path of the magnetic flux. For example, one magnetic element 516 can be positioned between the top plate 514 and the bottom plate 512 while a separate magnetic element 516 can be positioned at another location of the driver motor 500A but within the path of the magnetic flux. An example embodiment is shown in FIG. 5B.

Figure 5B:
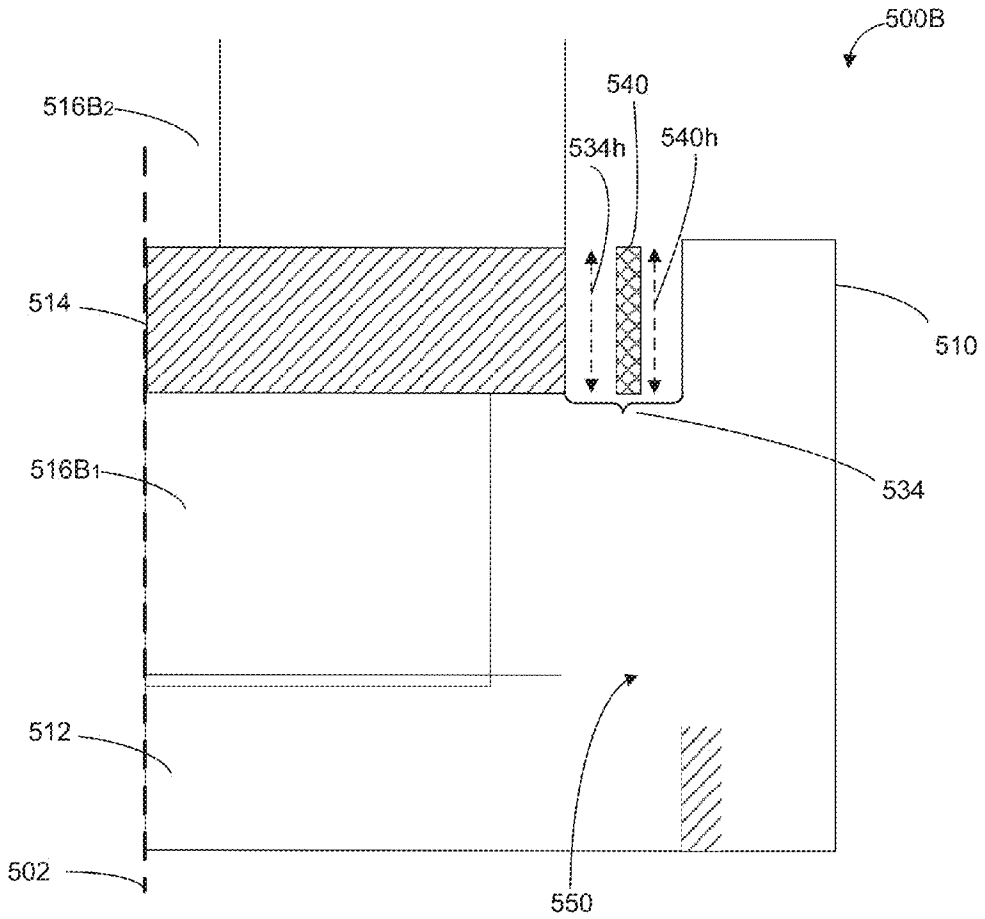
FIG. 5B is a partial cross-sectional drawing illustrating another example driver motor operable in the acoustic transducer systems described herein.

FIG. 5B is a partial cross-sectional drawing of yet another example driver motor 500B. Driver motor 500B is generally similar to driver motor 500A except the driver motor 500B includes a first magnetic element 516$B_1$ positioned between the bottom plate 512 and the top plate 514, and a second magnetic element 516$B_2$ positioned within the path of the magnetic flux. The first magnetic element 516$B_1$ can be coupled between a top surface of the bottom plate 512 and a bottom surface of the top plate 514, for example, while the magnetic element 516$B_2$ can be coupled to a top surface of the top plate 514. The top surface of the top plate 514 is opposite from the bottom surface of the top plate 514.

In some embodiments of the driver motors 200 to 500B, the axial post 210 to 510 may be formed integrally with the respective bottom plate 212 to 512.

The various modifications described with respect to the components in the driver motors 200 to 500B are example modifications for varying the amount of steel used without adversely affecting the overall performance of the acoustic transducer system 100. As shown in FIGS. 2 to 5B, the voice coil 240, 340, 440, 540 in each example driver motor 200 to 500B, respectively, can be associated with a coil height 240*h*, 340*h*, 440*h*, 540*h* that substantially corresponds to a gap height 234*h*, 334*h*, 434*h*, 534*h*.

In some embodiments, to further reduce the use of steel in the example driver motor 200 to 500B, depending on a radius of the driver motors 200, 300, 400, 500A, 500B, each of the respective top plate 214, 314, 414, 514 and the bottom plate 212, 312, 412, 512 can be tapered moving radially outward.

Figure 8:
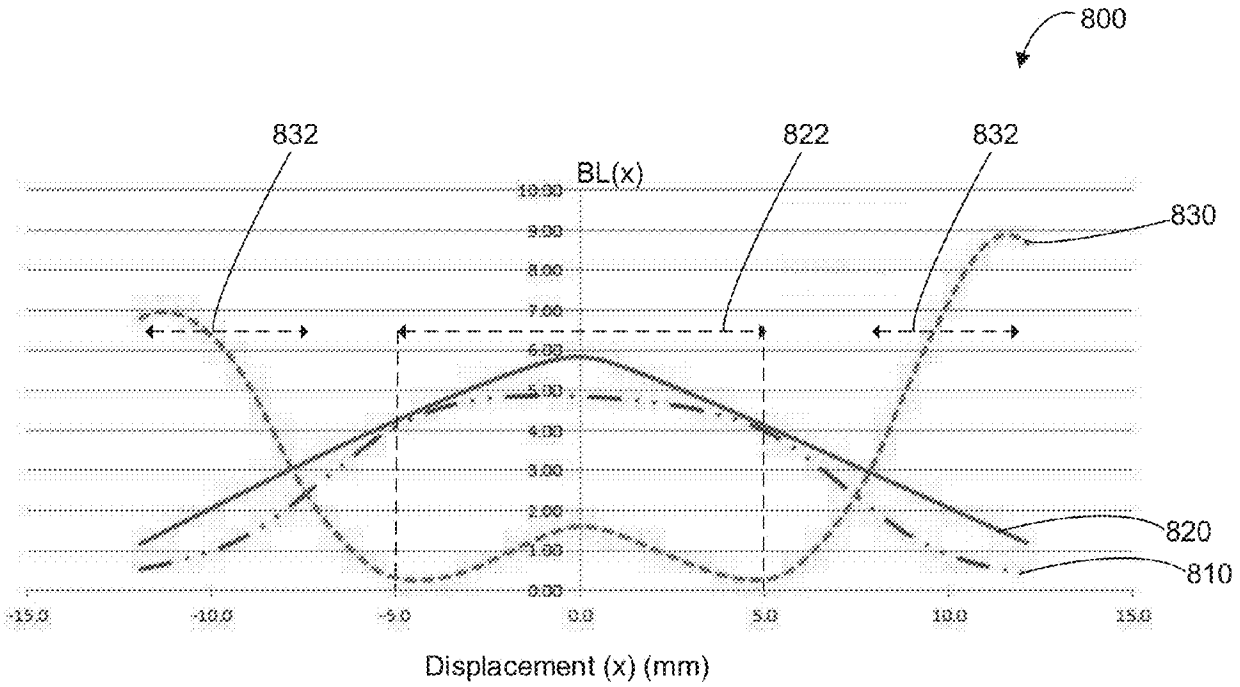
FIG. 8 is a plot illustrating electro-magnetic force (BI) generated by example driver motors.

Referring now to FIG. 8, which is a plot 800 illustrating example electro-magnetic force (BI(x)) generated by various example driver motors. The electro-magnetic force (BI) corresponds to a product of a magnetic field strength (B) in the air gap 234, 334, 434, 534 and a length (l) of the voice coil within the magnetic field.

Data series 810 illustrates the electro-magnetic force generated by a prior art overhung driver motor design. Data series 820 illustrates the electro-magnetic force generated by the driver motor 300 of FIG. 3. As shown in the plot 800, the values of the data series 820 are higher than the values of the data series 810 for all displacements. The relative efficiency of the driver motor 300, as shown with the data series 830, is fairly high in the high displacement range 832.

However, in the low displacement range 822 (e.g., when the voice coil 340 initially exits the air gap 334), the electro-magnetic force associated with the driver motor 300 is generally non-linear (as shown with data series 820) in comparison with the electro-magnetic force of the prior art driver motor designs (as shown with data series 810). The controller 122 described herein can operate to compensate for the non-linearity associated with the dependency of the BI magnitude on the displacement ("x") of the voice coil 340. Compensation of undesired changes within the magnetic field strength (B) within the air gap 234, 334, 434, 534 can be important since changes in the magnetic field strength (B) can affect the acoustic performance of acoustic transducer systems, such as the sensitivity and frequency response, and the linearity of the electro-magnetic force. Non-linear electro-magnetic force can produce distortions.

Figure 6:
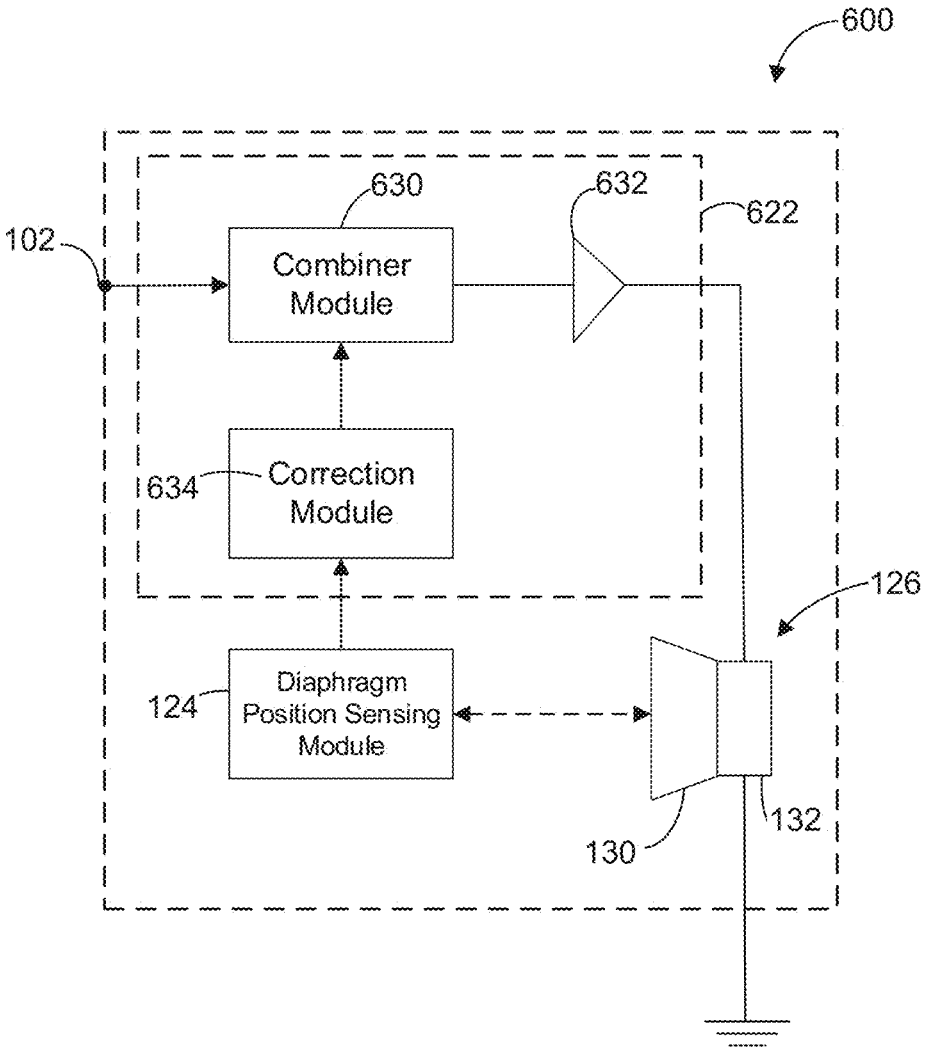
FIG. 6 is a block diagram of an acoustic transducer system in accordance with another example embodiment.

Referring now to FIG. 6, which illustrates a block diagram of another example acoustic transducer system 600. Similar to the acoustic transducer system 100 of FIG. 1, the acoustic transducer system 600 includes a controller 622, the diaphragm position sensing module 124 and the driver 126.

The controller 622 can include a combiner module 630, a transconductance amplifier 632, and a correction module 634.

In some embodiments, a voltage amplifier may be included in the controller 622 instead of the transconductance amplifier 632. With the voltage amplifier, the controller 622 can operate to adjust the voltage output signal generated by the voltage amplifier to result in a desired current for the acoustic transducer system 600. The adjustment to the voltage output signal can be applied based on the current sensed at an output terminal of the driver 126 via feedback, or via a calculated voltage/impedance to current conversion.

The correction module 634 can generate a correction signal based on the position signal received from the diaphragm position sensing module 124. Based on the position signal, the correction module 634 can determine the electro-magnetic force correction associated with the detected displacement and generate a corresponding correction signal to compensate for those distortions caused by the BI(x) term. The controller 622 can, therefore, operate as a feed-forward compensation system. For example, in respect of the plot 800 of FIG. 8, the correction signal can minimize the non-linearity in the data series 820 within the low displacement range 822. The correction signal may correspond to a function of the displacement and the control signal generated by the combiner module 630 may correspond to a ratio of the correction signal (that is, the BI(x) value where "x" corresponds to the displacement of the diaphragm 130) and the BI(0) value (e.g., when the diaphragm 130 is at the initial, or rest, position). The controller 622 may, in some embodiments, be configured to not generate a control signal for compensating low BI(x) values when the displacement nears predefined displacement limits for the acoustic transducer system 600.

In some embodiments, depending on the application of the acoustic transducer system 600, the correction signal can be generated for modifying the input audio signal into a target control signal. For example, when the acoustic transducer system 600 is intended to generate a maximum output signal, the correction module 634 can generate the correction signal so that when the correction signal is applied by the combiner module 630, the resulting control signal will cause the driver 126 to generate a maximum output signal. Another example target control signal can be associated with certain BI(x) characteristics and/or certain harmonic content within the audio output signal to be generated by the driver 126.

In some embodiments, the correction signal can also modify the input audio signal so that the resulting target control signal can emulate the acoustic behavior (including even the distortion characteristics) of a driver body with different motor geometry, such as an overhung topology or an underhung topology.

As shown in FIG. 6, the combiner module 630 can receive the correction signal from the correction module 634 and generate the control signal based on, at least, the correction signal and the input audio signal. The combiner module 630 can include a divider or a multiplier component depending on the form of the correction signal generated by the correction module. When the combiner module 630 includes the divider component, the control signal, therefore, can be a ratio of the input audio signal and the correction signal. The combiner module 630 may instead include the multiplier component when the correction signal corresponds to an inverse of the relative BI(x) term. Other implementations of the combiner module 630 may be applied, depending on the application of the acoustic transducer system 600.

The operation of the combiner module 630 can rely, to an extent, on the arrival of the input audio signal to be within a time threshold from the arrival of the corresponding correction signal. The time threshold can be frequency dependent. For example, the acceptable time threshold may be inversely proportional to an operational bandwidth of the acoustic transducer system 600. Any misalignment in arrival of the input audio signal and the corresponding correction signal can be minimized, in some embodiments, by reducing expected sources of delays, such as at stages in which the digitization of the position signal occurs and/or any modules involving signal processing (e.g., data conversion of digital signals to analog signals, and from analog signals to digital signals). For example, the delays can be minimized with the use of processing components associated with delays that are within the acceptable range of the overall acoustic transducer system 600.

In some embodiments, the acoustic transducer system 600 can include a filter between the diaphragm position sensing module 124 and the correction module 634 for minimizing possible misalignment in the arrival of the input audio signal and the corresponding correction signal at the combiner module 630. The filter can include filter types that exhibit negative group delay or predictive behavior, for example.

In some embodiments, the acoustic transducer system 600 can include protective elements.

Although not shown in FIG. 6, the thermal protection component can be included by reducing the gain of the transconductance amplifier 632 for protecting the acoustic transducer system 600 from thermal overload. The thermal protection component may involve determining the audio power, or RMS power, of the input audio signal applied to the voice coil 240, 340, 440, 540 and/or applying the input audio signal to a resistor-capacitor (RC) thermal model of the voice coil 240, 340, 440, 540. The RC thermal model can involve a fixed lump parameter, or two or more elements that represent different parts of the acoustic transducer system 600. For example, the RC thermal model can include different elements for representing each of the voice coil 240, 340, 440, 540 and the driver motor 200, 300, 400, 500. In some embodiments, the 'R' component of the RC thermal model may be a function of the RMS velocity (e.g., a RMS average of the time derivative of the displacement value).

During the operation of the acoustic transducer system 600, power is dissipated within the driver 126 and the temperature of the voice coil 240, 340, 440 and 540 rises. The temperature of other components, such as the driver 126, including the magnetic structure (e.g., magnetic elements 216, 316, 416, 516). Unlike the other thermally variable components within the acoustic transducer system 600, the voice coil 240, 340, 440 and 540 can be more susceptible to irreversible damage as a result of its increasing temperature. The controller 622 can, in some embodiments, further enhance the protection of the voice coil 240, 340, 440 and 540 with the temperature measurements received via sensor systems coupled to the driver 126.

For example, a sensor system can be coupled to the axial post 210 and that sensor system can include a temperature sensor for detecting a temperature of the axial post 210 and/or the surrounding of the axial post 210, such as the temperature within the air gap 234, the temperature at the interior surface 232, etc. Based on the temperatures detected by the temperature sensor, the controller 622 can estimate a temperature of the voice coil 240, 340, 440, 540 through mathematical models and/or representations (e.g., approximations generated through numerical methods) and generate the correction signal accordingly.

The controller 622 can, in some embodiments, include a thermal compensation component. The thermal compensation component can operate to address changes in the acoustic performance, such as sensitivity of the acoustic transducer system 600 and/or frequency response of the acoustic transducer system 600 (e.g., sensitivity over a range of frequency), caused by a strength variation in the magnetic element 216 due to the changing temperature. The thermal compensation component can include a temperature sensor coupled to the driver 126 for detecting a temperature of at least one component of the driver 126.

For example, the temperature sensor can be coupled to the magnetic structure within the driver 126, such as the magnetic element 216, for detecting a temperature of the magnetic element 216, or the temperature sensor can be coupled to one or more other thermally variable components in the driver 126, such as axial post 210 and/or bottom plate 212, for detecting the temperature of those thermally variable components and/or the surrounding temperature of the magnetic element 216. Based on the detected temperature of the other thermally variable components, the controller 622 can indirectly determine the temperature of the magnetic structure through mathematical models and/or representations (e.g., approximations generated through numerical methods). In some embodiments, a temperature sensor can be coupled to both the magnetic structure and one or more other thermally variable components within the driver 126.

In response to the detected and/or determined temperature, the controller 622 can generate a correction signal to compensate for any changes in the acoustic performance of the acoustic transducer system that may be caused by changes in the temperature of the magnetic structure of the driver 126. For example, the correction module 634 of the acoustic transducer system 600 may generate a correction signal for reducing or nulling the effect of the detected, or determined, temperature of the magnetic structure in order to compensate for the undesired effects caused by changes in the magnetic field strength (B) within the air gap 234, 334, 434, 534 due to the temperature changes of the magnetic structure and/or driver 126, as a whole.

In some embodiments, a temperature sensor can be coupled with the suspension structure of the driver 126, such as the surround and/or spider components. Similar to the effect that the changing temperature of the magnetic structure of the driver 126 can have on the magnetic field strength (B) in the air gap 234, 334, 434, 534 and, as a result, the acoustic performance of the acoustic transducer systems, the variable temperature of the suspension structure of the driver 126 can also affect the acoustic performance of the acoustic transducer systems.

When the driver 126 includes multiple suspension components within the suspension structure, the temperature of one or more of those suspension components can be detected. Suspension structures of drivers 126 can typically be constructed using materials which exhibit temperature dependent characteristics. The temperature of the suspension structures may be detected from a single point, or may be generated from measurements from multiple different points. For example, the multiple measurements may be averaged. Based on the detected, or determined, temperature of the suspension component(s), the controller 622 can then generate a corresponding correction signal for compensating the effect of the varying temperature at the suspension components on the suspension stiffness, which varies the displacement characteristics of the voice coil 340.

To determine the correction signal, the controller 622 can determine a suspension stiffness associated with the temperature of the suspension components. For example, the controller 622 may determine the corresponding suspension stiffness as a function of displacement, that is kms(x), from relevant mathematical models or representations (e.g., approximations generated through numerical methods), and/or data tables or arrays. The data tables, models and representations are characterized for a specific range of temperature. By determining the correction signal using those data tables, models and representations, the resulting correction signal will be applicable, at least, for those temperature ranges. The controller 622 may further interpolate or extrapolate between the data tables and representations, in some embodiments, to vary the scope of the temperature range. In some embodiments, the mathematical models and representations can also consider other characteristics of the suspension components of the driver 126 that may also be temperature dependent characteristics, such as hysteretic characteristics and/or viscoelastic characteristics (e.g., creep).

Another protective element that may be included in the acoustic transducer system 600 can include a compressor/limiter element. The compressor/limiter element can control the amplitude of the control signal before the control signal is provided to the driver 126 to ensure that the displacement is suitable for the driver 126. For example, the compressor/limiter element can operate to ensure that the control signal is within an operational limit of the driver 126.

The compressor/limiter element may operate to adjust an output signal from the transconductance amplifier 632 in some embodiments. In some other embodiments, the compressor/limiter element may operate as an adjustable gain block to adjust the input audio signal.

In some embodiments, the acoustic transducer system 600 can include a servomechanism for controlling any DC offset from the initial position of the voice coil 240, 340, 440, 540 that may result. The controlling of the DC offset may involve minimizing the DC offset. A signal corresponding to the DC offset, or a DC offset error signal, may be combined with the input audio signal.

Figure 7:
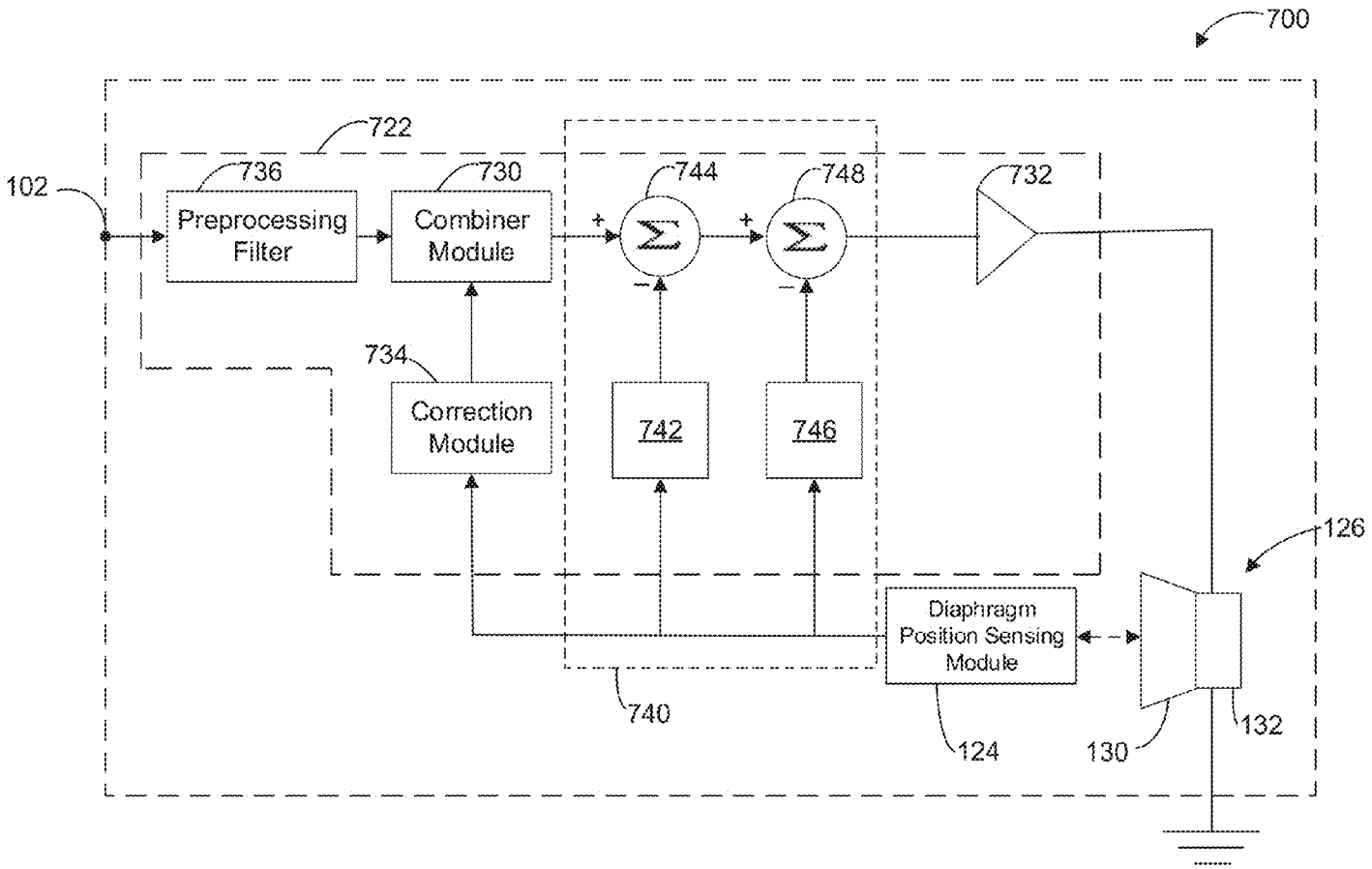
FIG. 7 is a block diagram of an acoustic transducer system in accordance with another example embodiment.

FIG. 7 illustrates a block diagram of another example acoustic transducer system 700.

Similar to the acoustic transducer systems 100 and 600, the acoustic transducer system 700 includes a controller 722, the diaphragm position sensing module 124 and the driver 126. The controller 722, like the controller 622, also includes a combiner module 730, a transconductance amplifier 732, and a correction module 734. However, unlike the controller 622, the controller 722 includes a preprocessing filter 736 and a negative feedback module 740. Although the preprocessing filter 736 and the negative feedback module 740 are both included in the acoustic transducer system 700, other embodiments may involve only one of the preprocessing filter 736 and the negative feedback module 740.

When the audio signal is provided to the voice coil 240, 340, 440, 540 via a current source, the impedance associated with the current source is high. Therefore, the mechanical dynamics of the driver 126 will be different than the behavior of a driver implemented with a voltage source. For example, the damping of the acoustic transducer system 700 can include damping associated with the moving diaphragm 130 and voice coil 240, 340, 440, 540, and as a result, the damping of the acoustic transducer system 700 can decrease as a result of the high impedance of the current source. The drop in damping can result in a rise in the output audio signals within the resonance frequency range, which can be undesirable. To minimize the drop in damping, in some embodiments, at least one of the preprocessing filter 736 and the negative feedback module 740 can be included in the acoustic transducer system 700.

The preprocessing filter 736 can include an equalization filter, for example. The preprocessing filter 736 can operate to adjust the input audio signal to generate a preprocessed input audio signal based on a target response of the acoustic transducer system 700. As described, the acoustic transducer system 700 may be configured to generate a desired type of output signal or response. The preprocessing filter 736 can adjust the input audio signal to accommodate the generation of the desired type of output signal by the acoustic transducer system 700 despite any under-damping that may occur. For example, the preprocessing filter 736 can involve applying a magnitude-frequency response that corresponds to an inverse of the response associated with the resonant peak of an underdamped acoustic transducer system 700.

The negative feedback module 740 can operate based on velocity feedback for controlling the damping of the acoustic transducer system 700. For example, the negative feedback module 740 can generate a motional velocity signal, and the combiner module 730 can then generate the control signal based on the correction signal, the input audio signal (or the preprocessed input audio signal generated by the preprocessing filter 736), and the velocity feedback signal.

As shown in FIG. 7, the negative feedback module 740 can include a velocity feedback module 742 that generates a velocity correction signal based on the position signal by taking a first time derivative of the position signal and a low pass filter 746 for generating a time averaged position signal. The time averaged position signal generally corresponds to a static or DC magnitude of the displacement of the diaphragm 130 relative to the initial position. A summer 744 can then subtract the velocity correction signal from an initial control signal generated by the combiner module 730, and another summer 748 can subtract the time averaged position signal generated by the low pass filter 746 from the result of the summer 744. The result of the summer 748 can be provided as the control signal to the transconductance amplifier 732.

In some embodiments, the velocity feedback module 742 can include a time derivative component and a first gain component. In some embodiments, the low pass filter 746 can also include a second gain component that may be different from the first gain component.

Various embodiments have been described herein by way of example only. Various modification and variations may be made to these example embodiments without departing from the spirit and scope of the invention, which is limited only by the appended claims.

We claim:

1. An acoustic transducer system comprising:

a driver motor operable to generate a magnetic flux;

a diaphragm operably coupled to the driver motor;

a voice coil coupled to the diaphragm, the voice coil being movable at least in response to the magnetic flux;

a diaphragm position sensing module generating a position signal corresponding to a displacement of the diaphragm relative to an initial position of the diaphragm; and a controller in electronic communication with the driver motor and the diaphragm position sensing module, the controller being operable to:

receive an input audio signal;

generate a correction signal based on the position signal, the correction signal compensating, at least, distortions associated with the detected displacement;

generate a motional feedback signal based on, at least, the position signal, the motional feedback signal operating to accommodate generation of a target response by the acoustic transducer system, the target response being a desired type of output signal for the acoustic transducer system;

generate a control signal based on, at least, the correction signal, a version of the input audio signal, and the motional feedback signal; and transmit the control signal to the voice coil, the voice coil moving at least in response to the control signal.

2. The acoustic transducer system of claim 1, wherein:

the driver motor comprises:

an axial post;

a bottom plate extending away from the axial post;

a top plate having an interior surface facing the axial post, wherein the top plate and the axial post defines an air gap therebetween; and a magnetic element positioned between the bottom plate and the top plate, the magnetic element being spaced away from the axial post and the magnetic element operable to generate the magnetic flux; and the voice coil is movable at least partially within the air gap.

3. The acoustic transducer system of claim 2, wherein the voice coil has a coil height corresponding substantially to a gap height of the air gap.

4. The acoustic transducer system of claim 2, wherein the axial post comprises a center post located at a substantially central region of the driver motor.

5. The acoustic transducer system of claim 2, wherein the axial post comprises an outer wall of the driver motor.

6. The acoustic transducer system of claim 5, wherein:

the magnetic element is coupled between the bottom plate and a bottom surface of the top plate; and the driver motor further comprises a second magnetic element coupled to a top surface of the top plate, the top surface of the top plate being opposite from the bottom surface of the top plate.

7. The acoustic transducer system of claim 2, wherein the top plate comprises an interior portion and an exterior portion coupled to the interior portion, a surface of the interior portion being the interior surface and the magnetic element being coupled to the top plate via the exterior portion, a height of the exterior portion being less than a height of the interior surface.

8. The acoustic transducer system of claim 7, wherein at least one of a top surface and a bottom surface of the interior portion of the top plate is tapered towards the exterior portion.

9. The acoustic transducer system of claim 2, wherein the magnetic element extends further away from the axial post than at least one of the bottom plate and the top plate.

10. The acoustic transducer system of claim 2, wherein the axial post and the bottom plate define a driver cavity within the driver motor for at least partially receiving the voice coil.

11. The acoustic transducer system of claim 2, wherein the driver motor is configured to accommodate a movement of the voice coil, the voice coil being movable towards and away from the bottom plate within a displacement range, the displacement range extends from each end of the air gap and the displacement range corresponds to at least a coil height of the voice coil.

12. The acoustic transducer system of claim 2, wherein a cross-sectional area of the axial post is at most equal to an area of the interior surface.

13. The acoustic transducer system of claim 2, wherein the axial post comprises a top portion and a bottom portion coupled to the top portion, a surface of the top portion partially facing the interior surface of the top plate and the bottom portion being coupled to the bottom plate.

14. The acoustic transducer system of claim 13, wherein the bottom portion of the axial post is tapered away from the bottom plate.

15. The acoustic transducer system of claim 13, wherein the top portion of the axial post is tapered away from the air gap.

16. The acoustic transducer system of claim 13, wherein the top portion of the axial post partially extends away from the bottom plate for extending the gap height.

17. The acoustic transducer system of claim 1, wherein the diaphragm position sensing module comprises a position sensor for detecting the displacement of the diaphragm.

18. An acoustic transducer system comprising:

a driver motor operable to generate a magnetic flux;

a diaphragm operably coupled to the driver motor;

a voice coil coupled to the diaphragm, the voice coil being movable at least in response to the magnetic flux;

a diaphragm position sensing module generating a position signal corresponding to a displacement of the diaphragm relative to an initial position of the diaphragm; and a controller in electronic communication with the driver motor and the diaphragm position sensing module, the controller being operable to:

receive an input audio signal, wherein the controller is operable to receive the input audio signal from a current source;

generate a correction signal based on the position signal, the correction signal compensating, at least, distortions associated with the detected displacement;

determine a target response defined for the acoustic transducer system, the target response being a desired type of output signal for the acoustic transducer system;

generate a preprocessed input audio signal from the input audio signal with reference to the target response, the input audio signal being adjusted to accommodate generation of the desired type of output signal; and generate a control signal based at least on the correction signal and the preprocessed input audio signal; and transmit the control signal to the voice coil, the voice coil moving at least in response to the control signal.

19. The acoustic transducer system of claim 1, wherein:

the controller comprises:

a velocity feedback module configured to generate a velocity correction signal based, at least, on the position signal; and a low pass filter configured to generate a version of the position signal; and the motional feedback signal comprises the velocity correction signal and the version of the position signal.

20. The acoustic transducer system of claim 1, wherein:

at least one temperature sensor is coupled to the driver motor; and the controller is further configured to:

estimate a temperature of the voice coil based on a temperature of the driver motor detected by the at least one temperature sensor; and generate the correction signal to minimize changes in performance of the acoustic transducer system due to the estimated temperature.

21. The acoustic transducer system of claim 20, wherein the at least one temperature sensor is coupled to the magnetic element.

22. The acoustic transducer system of claim 20, wherein:

the acoustic transducer system comprises a suspension structure operably coupled to the voice coil; and the at least one temperature sensor is coupled to the suspension structure.

23. The acoustic transducer system of claim 1, wherein the controller is further operated to:

determine, from the position signal, whether the displacement of the diaphragm satisfies a displacement limit defined for the acoustic transducer system, the displacement limit representing a maximum displacement range for the acoustic transducer system; and in response to determining the displacement of the diaphragm satisfies the displacement limit, not generate the control signal thereby causing no movement at the voice coil by the control signal, otherwise, generate the control signal based at least on the version of the input audio signal and the position signal.

24. The acoustic transducer system of claim 18, wherein:

at least one temperature sensor is coupled to the driver motor; and the controller is configured to:

estimate a temperature of the voice coil based on a temperature of the driver motor detected by the at least one temperature sensor; and generate the correction signal to minimize changes in performance of the acoustic transducer system due to the estimated temperature.

25. The acoustic transducer system of claim 18, wherein the controller is operated to:

determine, from the position signal, whether the displacement of the diaphragm satisfies a displacement limit defined for the acoustic transducer system, the displacement limit representing a maximum displacement range for the acoustic transducer system; and in response to determining the displacement of the diaphragm satisfies the displacement limit, not generate the control signal thereby causing no movement at the voice coil by the control signal, otherwise, generate the control signal based at least on the version of the input audio signal and the position signal.

* * * * *